US010006473B2

(12) United States Patent
Nishikawa et al.

(10) Patent No.: US 10,006,473 B2
(45) **Date of Patent: *Jun. 26, 2018**

(54) HYBRID CONSTRUCTION MACHINE

(71) Applicants: HITACHI CONSTRUCTION MACHINERY CO., LTD., Tokyo (JP); Takako Satake, Ishioka (JP)

(72) Inventors: Shinji Nishikawa, Kasumigaura (JP); Kouji Ishikawa, Kasumigaura (JP); Hidetoshi Satake, Ishioka (JP); Shinya Imura, Toride (JP); Shiho Izumi, Hitachinaka (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 405 days.

This patent is subject to a terminal disclaimer.

(21) Appl. No.: 14/729,364

(22) Filed: Jun. 3, 2015

(65) Prior Publication Data

US 2015/0354603 A1 Dec. 10, 2015

(30) Foreign Application Priority Data

Jun. 5, 2014 (JP) ..... 2014-116958

(51) Int. Cl.
*F15B 11/042* (2006.01)
*E02F 9/12* (2006.01)
(Continued)

(52) U.S. Cl.
CPC ..... *F15B 11/042* (2013.01); *E02F 9/123* (2013.01); *E02F 9/2095* (2013.01);
(Continued)

(58) Field of Classification Search
CPC ..... F15B 11/162; F15B 2211/30565; F15B 2211/3057; E02F 9/2095
(Continued)

(56) References Cited

U.S. PATENT DOCUMENTS 4,207,740 A * 6/1980 Ripa ..... E02F 3/42 137/596.13
6,131,391 A 10/2000 Poorman
(Continued)

FOREIGN PATENT DOCUMENTS

EP 2 620 555 A1 7/2013
JP 2011-241653 A 12/2011
(Continued)

OTHER PUBLICATIONS

Korean Office Action received in corresponding Korean Application No. 10-2015-0077146 dated Nov. 11, 2016.
(Continued)

*Primary Examiner* — Michael Leslie
*Assistant Examiner* — Matthew Wiblin
(74) *Attorney, Agent, or Firm* — Mattingly & Malur, PC

(57) ABSTRACT

This invention provides a hybrid construction machine including a swing structure, a hydraulic pump, a hydraulic swing motor driving the swing structure using hydraulic fluid from the hydraulic pump, an electric swing motor driving the swing structure in conjunction with the hydraulic swing motor, a boom cylinder operated simultaneously with the swing structure at times and driven by the hydraulic fluid from the hydraulic pump, a first directional control valve controlling flow of the hydraulic fluid supplied from the hydraulic pump to the hydraulic swing motor, a second directional control valve controlling the flow of the hydraulic fluid returning from the hydraulic swing motor, and a controller and solenoid pressure reducing valves which prevent operation of the second directional control valve when the boom cylinder is operated simultaneously with the swing structure.

4 Claims, 8 Drawing Sheets

(51) Int. Cl.
*E02F 9/20* (2006.01)
*E02F 9/22* (2006.01)
*F15B 11/08* (2006.01)

(52) U.S. Cl.
CPC ..... *E02F 9/2203* (2013.01); *E02F 9/2228* (2013.01); *E02F 9/2282* (2013.01); *E02F 9/2296* (2013.01); *F15B 11/08* (2013.01); *F15B 2211/20515* (2013.01); *F15B 2211/30525* (2013.01)

(58) Field of Classification Search
USPC ..... 91/455, 457
See application file for complete search history.

(56) References Cited

U.S. PATENT DOCUMENTS 8,958,958 B2 * 2/2015 Imura ..... E02F 9/123 180/53.1
2008/0072588 A1 * 3/2008 Ariga ..... E02F 9/2235 60/449
2012/0240582 A1 * 9/2012 Ooki ..... E02F 9/123 60/711
2013/0195597 A1 * 8/2013 Imura ..... E02F 9/123 414/744.2
2014/0165548 A1 * 6/2014 Satake ..... E02F 9/2075 60/420
2015/0219123 A1 8/2015 Nishikawa et al.

FOREIGN PATENT DOCUMENTS

JP 2014001769 A * 1/2014 ..... F15B 13/0402
WO WO 2012157510 A1 * 11/2012 ..... E02F 9/2075
WO 2014/073337 A1 5/2014

OTHER PUBLICATIONS

Extended European Search Report received in corresponding European Application No. 15170506.8 dated Jan. 29, 2016.

* cited by examiner

HYBRID CONSTRUCTION MACHINE

BACKGROUND OF THE INVENTION

1. Field of the Invention

The present invention relates to a hybrid construction machine that has both a hydraulic motor and an electric motor as driving sources for a swing structure.

2. Description of the Related Art

Construction machines (e.g., hydraulic excavators) include a hydraulic pump driven by an engine, a hydraulic actuator driven by hydraulic fluid from the hydraulic pump, and a swing structure. Some of such construction machines are of a hybrid type. The machines of the hybrid type are operable to allow an electric motor to drive and brake the swing structure and regenerate electric energy from the kinetic energy of the swing structure during braking operation. These construction machines aim at saving energy through cutbacks in the fuel consumption rate of the engine, the cutbacks achieved by driving the swing structure with the electric motor using the power regenerated during braking operation so as to lower the power for the hydraulic pump (i.e., engine load).

Some hybrid construction machines of this type include both a hydraulic motor (hydraulic swing motor) and an electric motor (electric swing motor) as the motors (swing motors) for swinging the swing structure (e.g., JP-2011-241653-A). The hydraulic system of this hybrid construction machine has a circuit structure in which the hydraulic fluid delivered by the same hydraulic pump is used to drive the hydraulic swing motor and another hydraulic actuator (hydraulic cylinder), as in the hydraulic system of conventional construction machines.

SUMMARY OF THE INVENTION

In the hydraulic system such as the above-cited one in which the hydraulic swing motor and another hydraulic actuator are supplied with the hydraulic fluid from the same hydraulic pump, more hydraulic fluid flows to the actuator under a relatively low load (at low load pressure) when the operator operates both the hydraulic swing motor and the another hydraulic actuator simultaneously. Therefore, when the load on the hydraulic swing motor is relatively low, more hydraulic fluid tends to flow to the hydraulic swing motor to accelerate the swing structure and thereby to reduce the manipulability of the operator. Particularly in the case of the hydraulic system in which the swing structure is driven by both the hydraulic swing motor and the electric swing motor, the load on the hydraulic swing motor is made lower than in conventional construction machines by the drive assist using the electric swing motor. This reinforces the above-mentioned tendency to cause more hydraulic fluid to flow into the hydraulic swing motor.

A general hydraulic system as above that has the hydraulic swing motor and another hydraulic actuator supplied with the hydraulic fluid from the same hydraulic pump is a system in which the boom cylinder of the hydraulic excavator is used as the another hydraulic actuator. In this hydraulic system, when a boom raising operation is performed during swing operation (swing boom raising operation), a relatively higher load exerted on the boom cylinder than on the hydraulic swing motor causes the hydraulic pump pressure to rise. Accordingly, high-pressure hydraulic fluid flows into (i.e., is forced into) the hydraulic swing motor under the lower load, accelerating the swing structure at times. For example, in cargo lifting work in which a lifted cargo is moved precisely to a predetermined target position while swinging slowly, when boom raising operation is performed to lift the cargo during low-speed swing, the swing structure may be accelerated unintentionally at the beginning of the boom raising operation. This can make it difficult for the operator to stop the lifted cargo accurately at the target position.

An object of the present invention is to provide a hybrid construction machine having a hydraulic motor and an electric motor as driving sources for a swing structure, the hybrid construction machine being configured to provide the operator with high manipulability during combined swing operation.

(1) To achieve the above object, the invention provides a hybrid construction machine including a swing structure, a hydraulic pump, a hydraulic swing motor driving the swing structure using hydraulic fluid from the hydraulic pump, an electric swing motor driving the swing structure in conjunction with the hydraulic swing motor, a hydraulic actuator operated simultaneously with the swing structure at times and driven by the hydraulic fluid from the hydraulic pump, a directional control valve for meter-in control controlling flow of the hydraulic fluid supplied from the hydraulic pump to the hydraulic swing motor, a directional control valve for meter-out control controlling the flow of the hydraulic fluid returning from the hydraulic swing motor, and a regulating device regulating operation of the directional control valve for meter-in control. When the hydraulic actuator is operated simultaneously with the swing structure, the regulating device prevents the operation of the directional control valve for meter-in control to cause the swing structure to be driven by the electric swing motor alone.

The present invention configured as above can provide the operator with high manipulability during combined swing operation.

(2) Preferably, in the above (1), the directional control valve for meter-in control is disposed on a center bypass hydraulic line constituting part of the hydraulic line for connecting the hydraulic pump to a tank, and has a function of controlling flow rate of the hydraulic fluid returning from the hydraulic pump to the tank. The directional control valve for meter-out control is disposed on a hydraulic line other than the center bypass hydraulic line.

(3) Preferably, in the above (1), the directional control valve for meter-in control is disposed on the center bypass hydraulic line constituting part of the hydraulic line for connecting the hydraulic pump to the tank, and has the function of controlling the flow rate of the hydraulic fluid returning from the hydraulic pump to the tank. The directional control valve for meter-out control is disposed on the center bypass hydraulic line, and does not have the function of controlling the flow rate of the hydraulic fluid returning from the hydraulic pump to the tank.

(4) Preferably, in the above (1), the directional control valve for meter-in control and the directional control valve for meter-out control are switched by the same operating pilot pressure. The regulating device has a valve mechanism for blocking the operating pilot pressure led to the directional control valve for meter-in control when the hydraulic actuator is operated simultaneously with the swing structure.

The present invention can thus provide a hybrid construction machine having a hydraulic motor and an electric motor as the driving sources for a swing structure, the hybrid construction machine being configured to provide the operator with high manipulability during combined swing operation.

DESCRIPTION OF THE PREFERRED EMBODIMENTS

Some preferred embodiments of the present invention will be explained below, taking a hydraulic excavator as an exemplary construction machine. This invention is applicable to all construction machines that have a swing structure and both a hydraulic swing motor and an electric swing motor as the driving sources for the swing structure. Thus the objects to which the present invention can be applied are not limited to the crawler type hydraulic excavator that will be explained hereunder. For example, the invention may also be applied to other construction machines including wheel type hydraulic excavators and cranes.

First Embodiment

Structure

Figure 1:
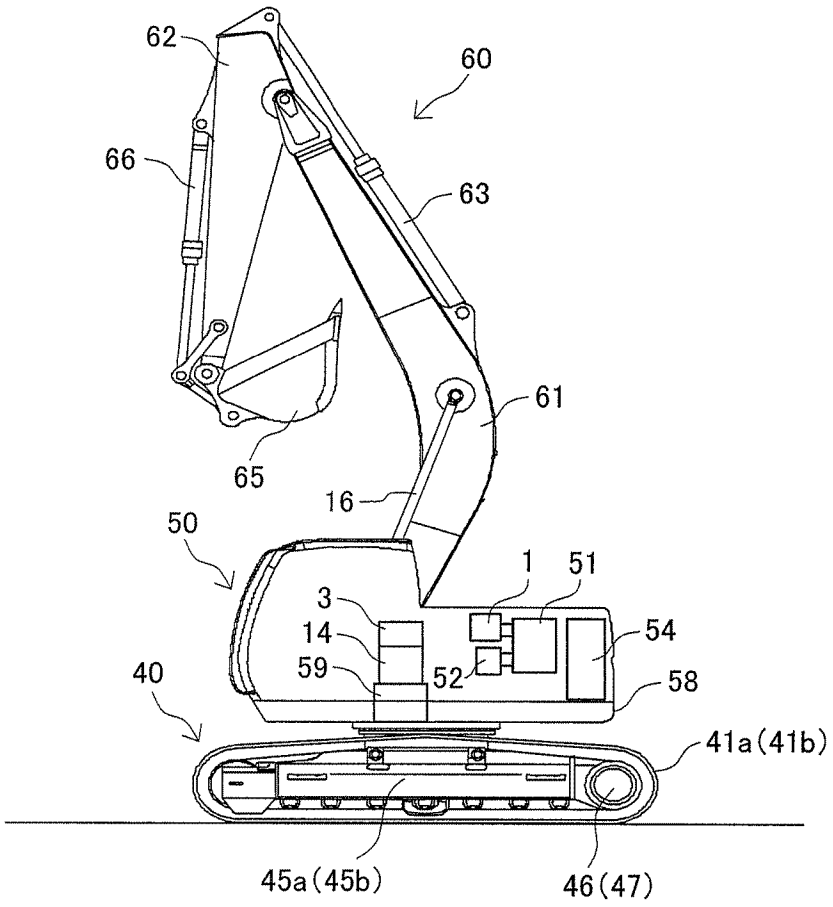
FIG. 1 is a side view of a hybrid type hydraulic excavator according to an embodiment of the present invention.

FIG. 1 is a side view of a hybrid type hydraulic excavator according to an embodiment of the present invention. The hybrid type excavator in FIG. 1 includes a lower track structure 40, an upper swing structure 50, and a front work implement 60.

The lower track structure 40 includes a pair of crawlers 41*a* and 41*b*, a pair of roller frames 45*a* and 45*b* (only one side is shown), a pair of traveling hydraulic motors 46 and 47 that control the drive of the crawlers 41*a* and 41*b* independently, and a speed reduction mechanism (not shown) for the motors.

The upper swing structure 50 includes an engine 51 as the prime mover, an assist power generation motor 52, a hydraulic pump 1, a hydraulic swing motor 3, an electric swing motor 14, an electrical storage device 54, a speed reduction mechanism 59, and a swing frame 58 on which these devices are mounted.

The assist power generation motor 52, which is coupled mechanically to the engine 51, assists the engine 51 when there remains power in the electrical storage device 54 and is driven by the engine 51 to generate power when there remains no power in the electrical storage device 54. The hydraulic pump 1, which is coupled mechanically to the engine 51, draws hydraulic fluid from a tank (not shown) and supplies the hydraulic fluid to the hydraulic actuators.

The hydraulic swing motor 3 and electric swing motor 14, which are both driving sources for the upper swing structure 50, swing the upper swing structure via the speed reduction mechanism 59. Given the hydraulic fluid from the hydraulic pump 1, the hydraulic swing motor 3 swings the upper swing structure 50. The electric swing motor 14 swings the upper swing structure 50 using the power from the electrical storage device 54 or from the assist power generation motor 52. How to use the hydraulic swing motor 3 and the electric swing motor 14 (e.g., whether both the hydraulic swing motor 3 and the electric swing motor 14 are to be used or either of them is to be used) as the driving source for the upper swing structure is suitably changed depending on the operating status of the other hydraulic actuators and on the remaining power level of the electrical storage device 54. The drive power of the electric swing motor 14 and hydraulic swing motor 3 is transmitted via the power reduction mechanism 59. The transmitted drive power swings the upper swing structure 50 (swing frame 58) relative to the lower track structure 40.

The electrical storage device 54 supplies power to the assist power generation motor 52 and the electric swing motor 14 and stores the power generated by these motors 52 and 14. An electric double layer capacitor, for example, may be used as the electrical storage device 54.

The front portion of the upper swing structure 50 is equipped with the front work implement 60 (excavator mechanism). The front work implement 60 includes a boom 61, a boom cylinder 16 for driving the boom 61, an arm 62 attached rotatably to the tip of the boom 61, an arm cylinder 63 for driving the arm 62, a bucket 65 attached rotatably to the tip of the arm 62, and a bucket cylinder 66 for driving the bucket 65.

Mounted on the swing frame 58 of the upper swing structure 50 is a valve block (not shown) that controls the drive of the hydraulic actuators for the above-mentioned traveling hydraulic motors 46 and 47, hydraulic swing motor 3, boom cylinder 16, arm cylinder 63, and bucket cylinder 66.

Figure 2:
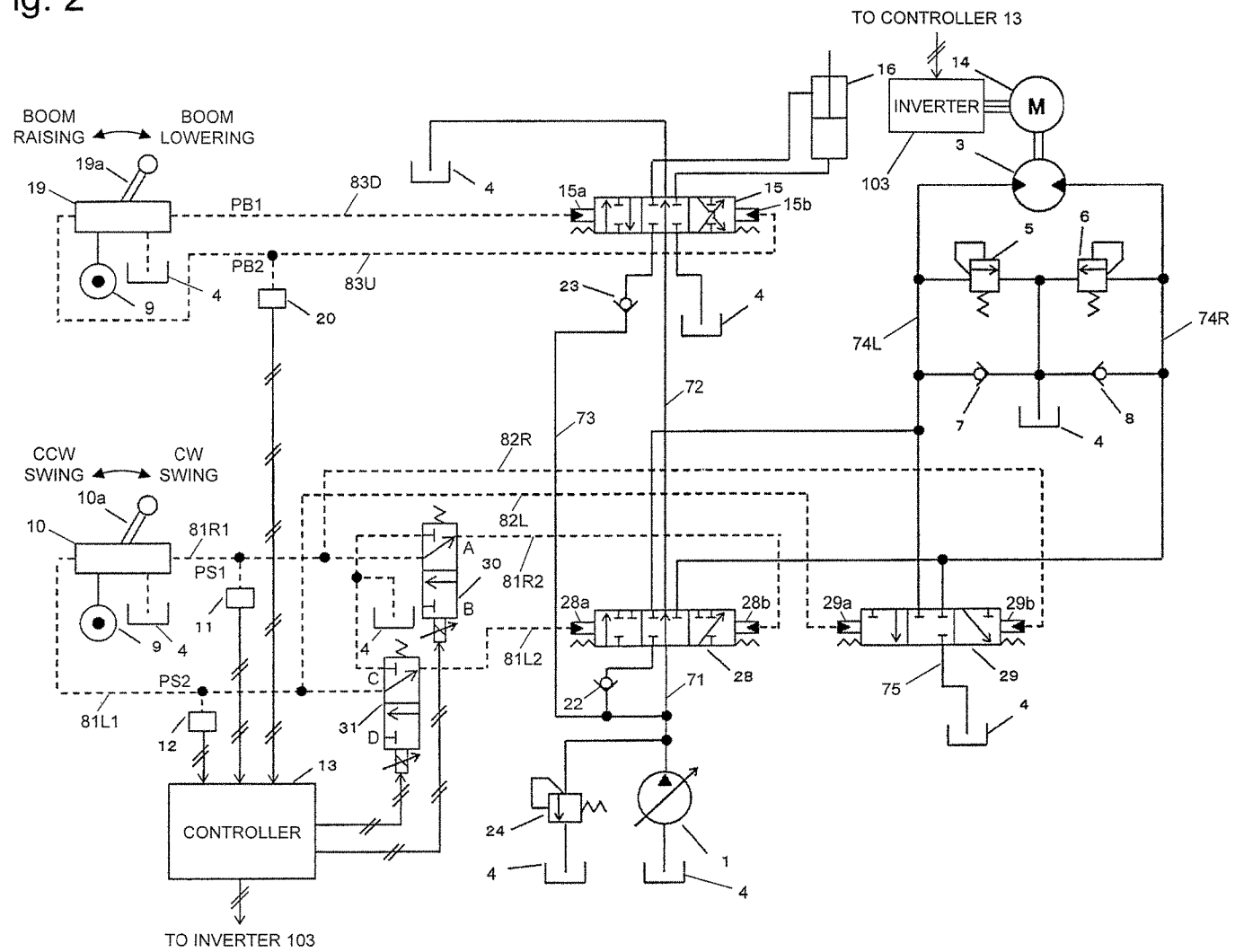
FIG. 2 is a schematic block diagram of a hydraulic system according to a first embodiment of the present invention.

FIG. 2 is a schematic block diagram of an open center hydraulic system incorporated in the hydraulic excavator (construction machine) according to the first embodiment of the present invention. Here, the hydraulic actuator operated at simultaneously with the upper swing structure 50 is assumed to be the boom cylinder 16. It is also assumed for explanation purposes that the target operation is "cargo lifting work" performed by use of a hook or the like attached near the connecting part between the arm and the bucket. For this reason, of the hydraulic actuators mounted on the hydraulic excavator in FIG. 1, only those associated with drive control of the hydraulic swing motor 3 and boom cylinder 16 are shown in FIG. 2. It should be noted that the same components as those in FIG. 1 are designated by the same reference characters in FIG. 2 and that their explanations may be omitted hereunder where appropriate (the same also applies to the subsequent drawings).

The hydraulic system shown in FIG. 2 includes: a directional control valve 28 (hereinafter referred to as "first directional control valve for swing") disposed on a center bypass hydraulic line 72 and controlling the direction and flow rate of the hydraulic fluid supplied to the hydraulic swing motor 3; a directional control valve 29 (hereinafter referred to as "second directional control valve for swing") disposed on a hydraulic line other than the center bypass hydraulic line 72 and controlling the flow rate of the hydraulic fluid discharged from the hydraulic swing motor 3; a directional control valve 15 (hereinafter referred to as "directional control valve for the boom") controlling the direction and flow rate of the hydraulic fluid supplied to the boom cylinder 16; a swing operating device 10 outputting a hydraulic operation signal (pilot pressure) for operating the swing operation of the upper swing structure 50; a boom operating device 19 outputting a hydraulic operation signal (pilot pressure) for operating the rotating operation of the boom 61 (extending/retracting operation of the boom cylinder 16); solenoid pressure reducing valves 30 and 31; a controller 13 controlling the entire hydraulic excavator including the control of the electric swing motor 14 and of the solenoid pressure reducing valves 30 and 31; an inverter device 103 controlling the electric swing motor 14 based on a control signal from the controller 13; and a relief valve 24.

A hydraulic fluid supply line 71 through which the hydraulic fluid delivered from the hydraulic pump 1 flows is connected to the center bypass hydraulic line 72. The hydraulic fluid supply line 71 is also coupled to a meter-in hydraulic line 73 in parallel with the center bypass hydraulic line 72.

The center bypass hydraulic line 72 leads to a tank 4 past a center bypass opening of the first directional control valve 28 for swing and then a center bypass opening of the directional control valve 15 for the boom. That is, the center bypass hydraulic line 72 is connected to the two directional control valves 28 and 15 in series.

The meter-in hydraulic line 73 guides the hydraulic fluid from the hydraulic pump 1 to the hydraulic actuators (hydraulic swing motor 3 and boom cylinder 16) through meter-in openings of the directional control valves 28 and 15. In this embodiment, the two directional control valves 28 and 15 (two hydraulic actuators 3 and 16) are connected in parallel via the meter-in hydraulic line 73.

Check valves 22 and 23 are disposed immediately before where the meter-in hydraulic line 73 is connected to the directional control valves 28 and 15, respectively. The check valves 22 and 23 permit the flow of the hydraulic fluid from the meter-in hydraulic line 73 to the hydraulic actuators 3 and 16 only when the delivery pressure (pump pressure) of the hydraulic pump 1 is higher than the load pressure of the hydraulic actuators 3 and 16.

Comparing the low-speed drive of the upper swing structure 50 (when the operation amount of a control lever 10*a* of the swing operating device 10 is relatively small) to the low-speed drive of the boom 61 (when the operation amount of a control lever 19*a* of the boom operating device 19 is relatively small) reveals that the load pressure of the hydraulic swing motor 3 (pump load from swing) is lower than the load pressure of the boom cylinder 16 (pump load from boom raising). For this reason, the opening area of the center bypass throttle of the directional control valve 15 for the boom is set to be relatively smaller (i.e., throttle amount is relatively larger) than the opening area of the center bypass throttle of the directional control valve 28 for swing so that given the same lever operation amount, the pump pressure at the time of boom raising will be higher than the pump pressure at the time of swing operation.

The relief valve 24 is connected to the hydraulic fluid supply line 71. When the pump pressure reaches a relief pressure, the relief valve 24 releases the hydraulic fluid from the hydraulic fluid supply line 71 into the tank 4.

A primary pilot pressure is led to the swing operating device 10 from a pilot hydraulic pressure source 9 equipped with a pilot pump (not shown) driven by the engine 51. The swing operating device 10 reduces the primary pilot pressure from the pilot hydraulic pressure source 9 in accordance with the operation amount of the control lever 10*a* and generates a pilot pressure PS1 or PS2 in keeping with the operating direction of the control lever 10*a*. The pilot pressure PS1 or PS2 generated by the swing operating device 10 is led to a pressure receiving part 28*b* or 28*a* of the first directional control valve 28 for swing via pilot hydraulic lines 81R1, 81R2 or 81L1, 81L2. The pilot pressure PS1 or PS2 is also led to a pressure receiving part 29*b* or 29*a* of the second directional control valve 29 for swing via a pilot hydraulic line 82R or 82L branched from the pilot hydraulic line 81R1 or 81L1, respectively. The solenoid pressure reducing valve 30 is interposed between the pilot hydraulic lines 81R1 and 81R2, and the solenoid pressure reducing valve 31 is interposed between the pilot hydraulic lines 81L1 and 81L2. When the solenoid pressure reducing valves 30 and 31 are positioned as indicated in the drawing (i.e., at positions A and C), the first and the second directional control valves 28 and 29 are switched simultaneously by use of the same pilot pressure PS1 or PS2.

When the control lever 10*a* of the swing operating device 10 is operated in the clockwise swing direction, the pilot pressure PS1 led via the pilot hydraulic lines 81R1 and 82R switches the second directional control valve 29 to the right position (in the leftward direction). The switched valve widens a meter-out opening that connects an actuator hydraulic line 74L to a hydraulic fluid drain line 75, allowing the hydraulic fluid returning from the hydraulic swing motor 3 to be drained into the tank 4 (meter-out control). Furthermore, when the solenoid pressure reducing valve 30 is at the position A, the pilot pressure PS1 led via the pilot hydraulic lines 81R1 and 81R2 switches the first directional control valve 28 to the right position (in the leftward direction). The switched valve throttles the center bypass opening (to lower the flow rate of the hydraulic fluid returning from the hydraulic pump 1 to the tank 4 via the center bypass hydraulic line 72). The switched valve also widens the meter-in opening that connects the meter-in hydraulic line 73 to an actuator hydraulic line 74R, supplying the hydraulic fluid to the hydraulic swing motor 3 (meter-in control). Accordingly, the hydraulic swing motor 3 generates output torque which then swings the upper swing structure 50 in the clockwise direction.

By contrast, when the control lever 10*a* of the swing operating device 10 is operated in the counterclockwise swing direction, the pilot pressure PS2 led via the pilot hydraulic lines 81L1 and 82L switches the second directional control valve 29 to the left position (in the rightward direction). The switched valve widens the meter-out opening that connects the actuator hydraulic line 74R to the hydraulic fluid drain line 75, allowing the hydraulic fluid returning from the hydraulic swing motor 3 to be drained into the tank 4 (meter-out control). Furthermore, when the solenoid pressure reducing valve 31 is at the position C, the pilot pressure PS2 led via the pilot hydraulic lines 81L1 and 81L2 switches the first directional control valve 28 to the left position (in the rightward direction). The switched valve throttles the center bypass opening (to lower the flow rate of the hydraulic fluid returning from the hydraulic pump 1 to the tank 4 via the center bypass hydraulic line 72). The switched valve also widens the meter-in opening that connects the meter-in hydraulic line 73 to the actuator hydraulic line 74L, supplying the hydraulic fluid to the hydraulic swing motor 3 (meter-in control). Accordingly, the hydraulic swing motor 3 generates output torque, thereby swinging the upper swing structure 50 in the counterclockwise direction.

As described above, the meter-in control that controls the flow of the hydraulic fluid supplied to the hydraulic swing motor 3 and the meter-out control that controls the flow of the hydraulic fluid returning from the hydraulic swing motor 3 are performed separately by the two directional control valves 28 and 29.

The pilot hydraulic lines 81R1 and 81L1 are equipped respectively with a pressure sensor 11 (hereinafter referred to as "clockwise swing pilot pressure sensor") and a pressure sensor 12 (hereinafter referred to as "counterclockwise swing pilot pressure sensor"). The pilot pressures PS1 and PS2 detected by the clockwise and counterclockwise swing pilot pressure sensors 11 and 12 are outputted to the controller 13.

The actuator hydraulic line 74L is connected to a relief value 5 and a makeup valve 7, and the actuator hydraulic line 74R is connected to a relief valve 6 and a makeup valve 8. The relief valves 5 and 6 serve to release the hydraulic fluid having reached the relief pressure into the tank 4, thereby offering the function of protecting circuits by cutting down an abnormal pressure generated at the time of swing acceleration or deceleration, etc. The makeup valves 7 and 8 draw the hydraulic fluid from the tank 4 when the hydraulic fluid becomes insufficient in the hydraulic lines and the fluid pressure therein drops below the tank pressure. The makeup valves 7 and 8 thus offer the function of preventing cavitation in the circuits.

The hydraulic swing motor 3 is connected coaxially to the electric swing motor 14. The drive and braking of the electric swing motor 14 are controlled by the inverter device 103. At the time of solo swing operation (when only the upper swing structure 50 is operated and all other actuators are stopped), the upper swing structure 50 is driven to swing by the total output torque of the hydraulic swing motor 3 and electric swing motor 14. The electric swing motor 14 and hydraulic swing motor 3 need not be mechanically directly coupled. These motors may be coupled indirectly by a suitable mechanism as long as the motors are configured to drive the upper swing structure as their common drive target.

As with the swing operating device 10, the boom operating device 19 is supplied with the primary pilot pressure from the pilot hydraulic pressure source 9. The boom operating device 19 reduces the primary pilot pressure in accordance with the operation amount of the control lever 19*a*, and generates a pilot pressure PB1 or PB2 in keeping with the operating direction of the control lever 19*a*. The pilot pressure PB1 or PB2 generated by the boom operating device 19 is led to a pressure receiving part 15*a* or 15*b* of the directional control valve 15 for the boom via a pilot hydraulic line 83D or 83U, thereby switching the directional control valve 15 for the boom.

The pilot hydraulic line 83U, in which the pilot pressure PB2 (hereinafter referred to as "boom raising pilot pressure") is generated by operation of the control lever 19*a* of the boom operating device 19 in the boom raising direction, has a pressure sensor 20 (hereinafter referred to as "boom raising pilot pressure sensor"). The boom raising pilot pressure PB2 detected by the boom raising pilot pressure sensor 20 is outputted to the controller 13.

The directional control valve 15 for the boom supplies the boom cylinder 16 with the hydraulic fluid led via the meter-in hydraulic line 73.

When the control lever 19*a* of the boom operating device 19 is operated in the boom raising direction, the directional control valve 15 for the boom is shifted to the right position in the drawing (in the leftward direction). The shifted valve causes a bottom-side hydraulic chamber of the boom cylinder 16 to be supplied with the hydraulic fluid from the hydraulic pump 1 and allows the hydraulic fluid discharged from a rod-side hydraulic chamber of the boom cylinder 16 to return to the tank 4, thereby extending the boom cylinder 16.

By contrast, when the control lever 19*a* of the boom operating device 19 is operated in the boom lowering direction, the directional control valve 15 for the boom is shifted to the left position in the drawing (in the rightward direction). The shifted valve causes the rod-side hydraulic chamber of the boom cylinder 16 to be supplied with the hydraulic fluid from the hydraulic pump 1 and allows the hydraulic fluid discharged from the bottom-side hydraulic chamber of the boom cylinder 16 to return to the tank 4, thereby retracting the boom cylinder 1.

The solenoid pressure reducing valve 30 can be switched between positions A and B. At the position A, the solenoid pressure reducing valve 30 connects the clockwise swing pilot hydraulic lines 81R1 and 81R2 to each other; at the position B, the solenoid pressure reducing valve 30 disconnects the pilot hydraulic lines 81R1 and 81R2 from each other and connects the pilot hydraulic line 81R2 to the tank 4. The switching between the two positions is controlled by an electric signal (ON/OFF signal) which is inputted from the controller 13. The OFF signal being inputted from the controller 13, the solenoid pressure reducing valve 30 is switched to the position A and leads the pilot pressure PS2 generated by the swing operating device 10 to the pressure receiving part 28*b* of the first directional control valve 28. This enables the first directional control valve 28 to be switched to the right position (in the leftward direction). By contrast, the ON signal being inputted from the controller 13, the solenoid pressure reducing valve 30 is switched to the position B and keeps the pilot pressure PS2 from being led to the pressure receiving part 28*b*. This prevents the first directional control valve 28 from being switched to the right position (in the leftward direction).

The solenoid pressure reducing valve 31 can be switched between positions C and D. At the position C, the solenoid pressure reducing valve 31 connects the pilot hydraulic lines 81L1 and 81L2 to each other; at the position D, the solenoid pressure reducing valve 31 disconnects the pilot hydraulic lines 81L1 and 81L2 from each other and connects the pilot hydraulic line 81L2 to the tank 4. The switching between the two positions is controlled by an electric signal (ON/OFF signal) inputted from the controller 13. The OFF signal being inputted from the controller 13, the solenoid pressure reducing valve 31 is switched to the position C and leads the pilot pressure PS2 generated by the swing operating device 10 to the pressure receiving part 28*a* of the first directional control valve 28. This enables the first directional control valve 28 to be switched to the left position (in the rightward direction). By contrast, the ON signal being inputted from the controller 13, the solenoid pressure reducing valve 31 is switched to the position D and keeps the pilot pressure PS2 from being led to the pressure receiving part 28*b*. This prevents the first directional control valve 28 from being switched to the left position (in the rightward direction).

Control

Figure 3:
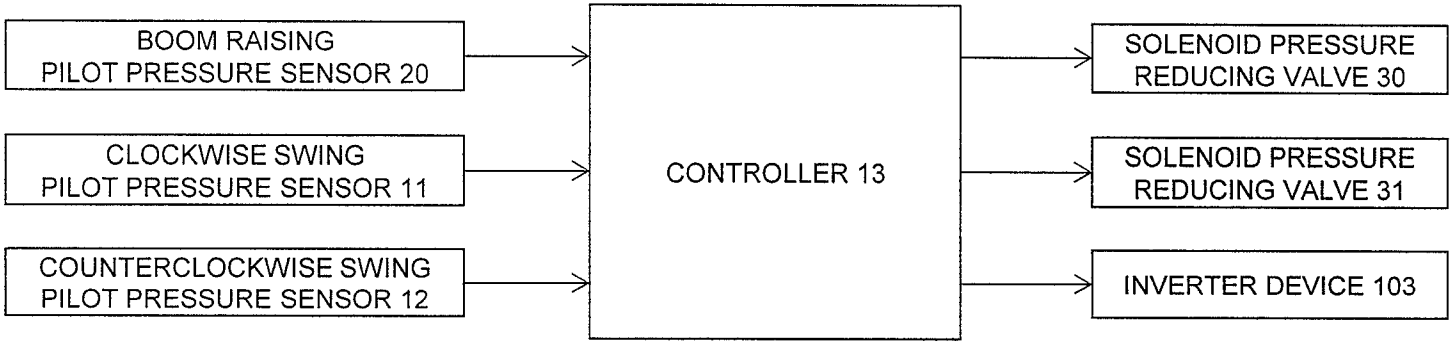
FIG. 3 is a control block diagram of solenoid' pressure reducing valves and an inverter device according to the embodiment.

FIG. 3 is a control block diagram of the solenoid pressure reducing valves 30 and 31 and the inverter device 103. On the basis of output values from the boom raising pilot pressure sensor 20 and from the clockwise and counterclockwise swing pilot pressure sensors 11 and 12, the controller 13 judges whether the control lever 19*a* of the boom operating device 19 has been operated in the boom raising direction (i.e., whether the boom raising operation has been performed) and whether the control lever 10*a* of the swing operating device 10 has been operated (i.e., whether the swing operation has been performed). In accordance with the judgment, the controller 13 outputs electric signals to control the solenoid pressure reducing valves 30 and 31 and the inverter device 103. One example of a specific method for judging whether the swing operation or the boom raising operation has been performed is as follows: A minimum pilot pressure P0 (e.g., 1.0 MPa) generated when the control lever 10*a* or 19*a* of the operating device 10 or 19 is operated is set to be a threshold pressure; Whether the swing operation or the boom raising operation has been performed is judged by checking if the pilot pressure PS1, PS2 or PB2 detected by the pressure sensor 11, 12 or 20 has exceeded the threshold pressure P0.

Figure 4:
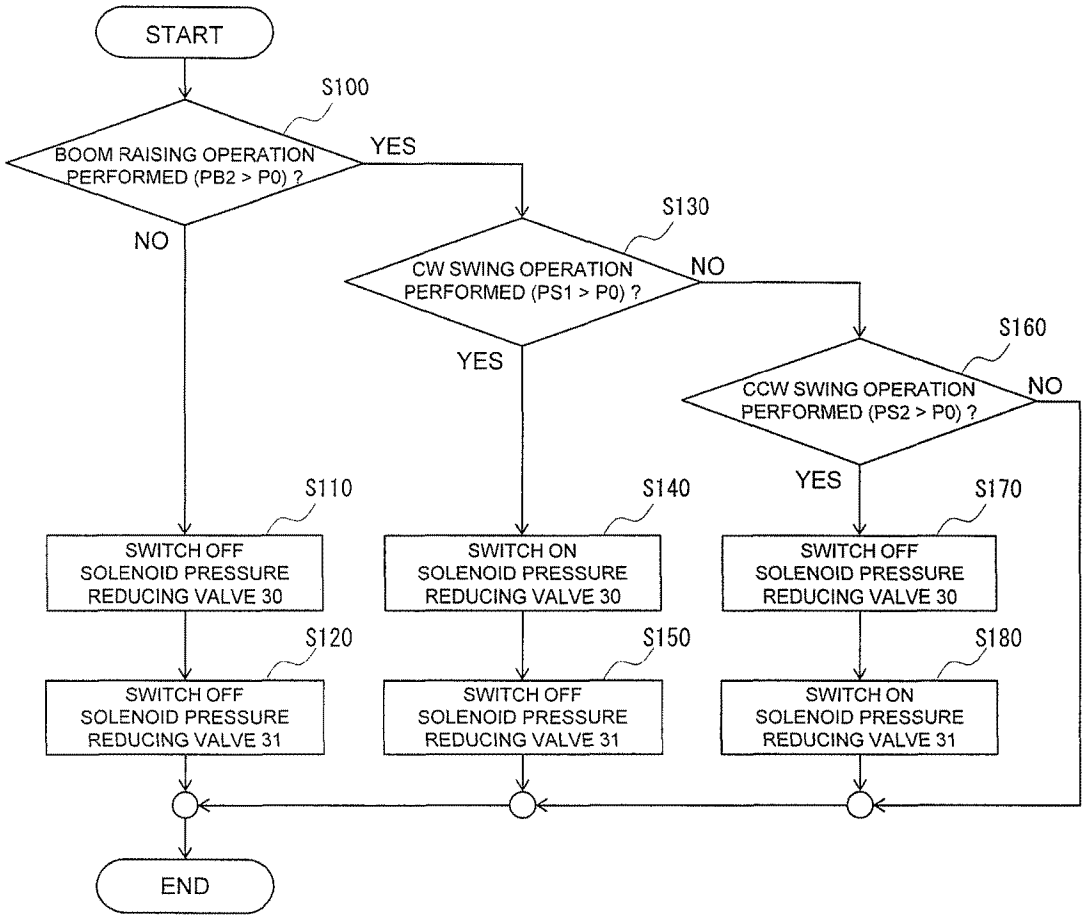
FIG. 4 is a control flow diagram of the solenoid pressure reducing valves according to the embodiment.

FIG. 4 is a control flow diagram of the solenoid pressure reducing valves 30 and 31 when the above judging method is applied (how the inverter device 103 is controlled will be discussed later). The steps constituting the control flow will be sequentially described in detail below with reference to FIG. 4.

First in step S100, it is judged whether the boom raising pilot pressure PB2 is higher than the threshold pressure P0 (whether the boom raising operation has been performed). If it is judged in step S100 that the boom raising operation has not been performed (NO), an OFF signal is outputted to the solenoid pressure reducing valve 30 to switch the valve to the position A (step S110), and an OFF signal is outputted to the solenoid pressure reducing valve 31 to switch the valve to the position C (step S120). This enables the first directional control valve 28 for meter-in control to be switched so that the hydraulic swing motor 3 generates output torque in accordance with the pilot pressure PS1 or PS2.

If it is judged in step S100 that the boom raising operation has been performed (YES), it is then judged (in step S130) whether the clockwise swing pilot pressure PS1 is higher than the threshold pressure P0 (whether the clockwise swing operation has been performed). If it is judged in step S130 that the clockwise swing operation has been performed (YES), an ON signal is outputted to the solenoid pressure reducing valve 30 to switch the valve to the position B (step S140), and an OFF signal is then outputted to the solenoid pressure reducing valve 31 to switch the valve to the position C (step S150). This prevents the first directional control valve 28 for meter-in control from being switched to the right position (in the leftward direction) at the time of clockwise swing drive. The hydraulic swing motor 3 thus does not generate output torque.

If it is judged in step S130 that the clockwise swing operation has not been performed (NO), it is then judged (in step S160) whether the counterclockwise swing pilot pressure PS2 is higher than the threshold pressure P0 (whether the counterclockwise swing operation has been performed). If it is judged in step S160 that the counterclockwise swing operation has been performed (YES), an OFF signal is outputted to the solenoid pressure reducing valve 30 to switch the valve to the position A (step S170), and an ON signal is then outputted to the solenoid pressure reducing valve 31 to switch the valve to the position D (step S180). This prevents the first directional control valve 28 for meter-in control from being switched to the left position (in the rightward direction) at the time of counterclockwise swing drive. The hydraulic swing motor 3 thus does not generate output torque.

If it is judged in step S160 that the counterclockwise swing operation has not been performed (NO), the solenoid pressure reducing valves 30 and 31 are not controlled to be switched. At this point, the pilot pressures PS1 and PS2 are both lower than the threshold pressure P0 so that the first directional control valve 28 is not switched regardless of the positions of the solenoid pressure reducing valves 30 and 31. The hydraulic swing motor 3 thus does not generate output torque.

While the judgment of whether the clockwise swing operation has been performed is followed by the judgment of whether the counterclockwise swing operation has been performed in the control flow shown in FIG. 4 (step S130 is followed by step S140), the judgment of whether the counterclockwise swing operation has been performed may come first. In the control flow of this case, steps S130, S140 and S150 are switched with steps S160, S170 and S180, respectively.

As described above, the solenoid pressure reducing valves 30 and 31 and the controller 13 constitute a regulating device that regulates the operation of the first directional control valve 28 for meter-in control. When the boom raising operation and the swing operation are performed simultaneously (i.e., when the boom cylinder 16 and the swing structure 50 are operated at the same time), the regulating device prevents the operation of the first directional control valve 28 for meter-in control.

Also, in parallel with control of the solenoid pressure reducing valves 30 and 31 shown in FIG. 4, the controller 13 generates control signals with which the inverter device 103 controls the electric swing motor 14 in such a manner that the upper swing structure 50 is swung in accordance with the operating direction and operation amount of the control lever 10*a* of the swing operating device 10 (i.e., in accordance with output values from the clockwise and counterclockwise swing pilot pressure sensors 11 and 12) regardless of whether operations other than the swing operation have been performed. The generated control signals are subsequently outputted to the inverter device 103. On the basis of the control signals outputted from the controller 13, the inverter device 103 controls the electric swing motor 14. The electric swing motor 14 may be controlled by the controller 13 using the inverter device 103 according to a known method. One such method involves placing the electric swing motor 14 under feedback control to make up for the insufficient torque of the hydraulic swing motor 3 in such a manner that the speed of the upper swing structure 50 approaches the target speed determined by the operation amount of the control lever 10*a* of the swing operating device 10. Another such method is a torque control scheme that involves controlling the output torque of the electric swing motor 14 and that of the hydraulic swing motor 3 in such a manner that the total output torque of the electric swing motor 14 and hydraulic swing motor 3 equals the target swing torque calculated from the operation amount of the control lever 10*a*.

Figure 5:
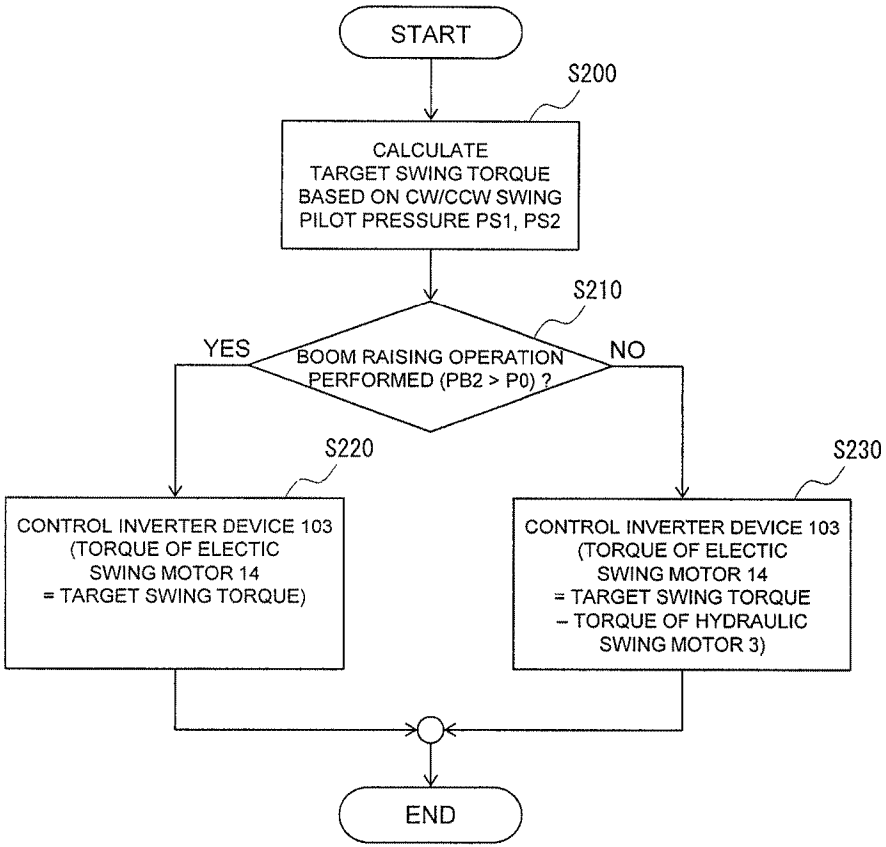
FIG. 5 is a control flow diagram of the inverter device according to the embodiment.

FIG. 5 is a control flow diagram of the inverter device 103 when the torque control scheme is adopted. The steps constituting the control flow will be sequentially described in detail below with reference to FIG. 5.

First in step S200, the target swing torque is calculated based on the clockwise or counterclockwise swing pilot pressure PS1 or PS2. It is then judged (in step S210) whether the boom raising pilot pressure PB2 is higher than the threshold pressure P0 (whether the boom raising operation has been performed).

If it is judged in step S210 that the boom raising operation has been performed (YES), the inverter device 103 is controlled (in step S220) in such a manner that the output torque of the electric swing motor 14 equals the target swing torque since the hydraulic swing motor 3 does not generate output torque under the control shown in FIG. 4. Accordingly, the output torque of the electric swing motor alone (=target swing torque) drives the upper swing structure 50 to swing.

If it is judged in step S210 that the boom raising operation has not been performed (NO), the inverter device 103 is controlled (in step S230) in such a manner that the output torque of the electric swing motor 14 equals the torque obtained by subtracting the output torque of the hydraulic swing motor 3 from the target swing torque since the hydraulic swing motor 3 generates output torque under the control shown in FIG. 4. Accordingly, the total output torque of the hydraulic swing motor 3 and electric swing motor 14 (=target swing torque) drives the upper swing structure 50 to swing.

Operation

The following paragraphs will first explain the operation of a conventional hydraulic system and then explain the operation of the hydraulic system according to this embodiment in comparison with that of the conventional hydraulic system. Since the hydraulic system according to this embodiment is of the open center type (shown in FIG. 2), the conventional hydraulic system to be explained below will also be of the open center type.

Figure 6:
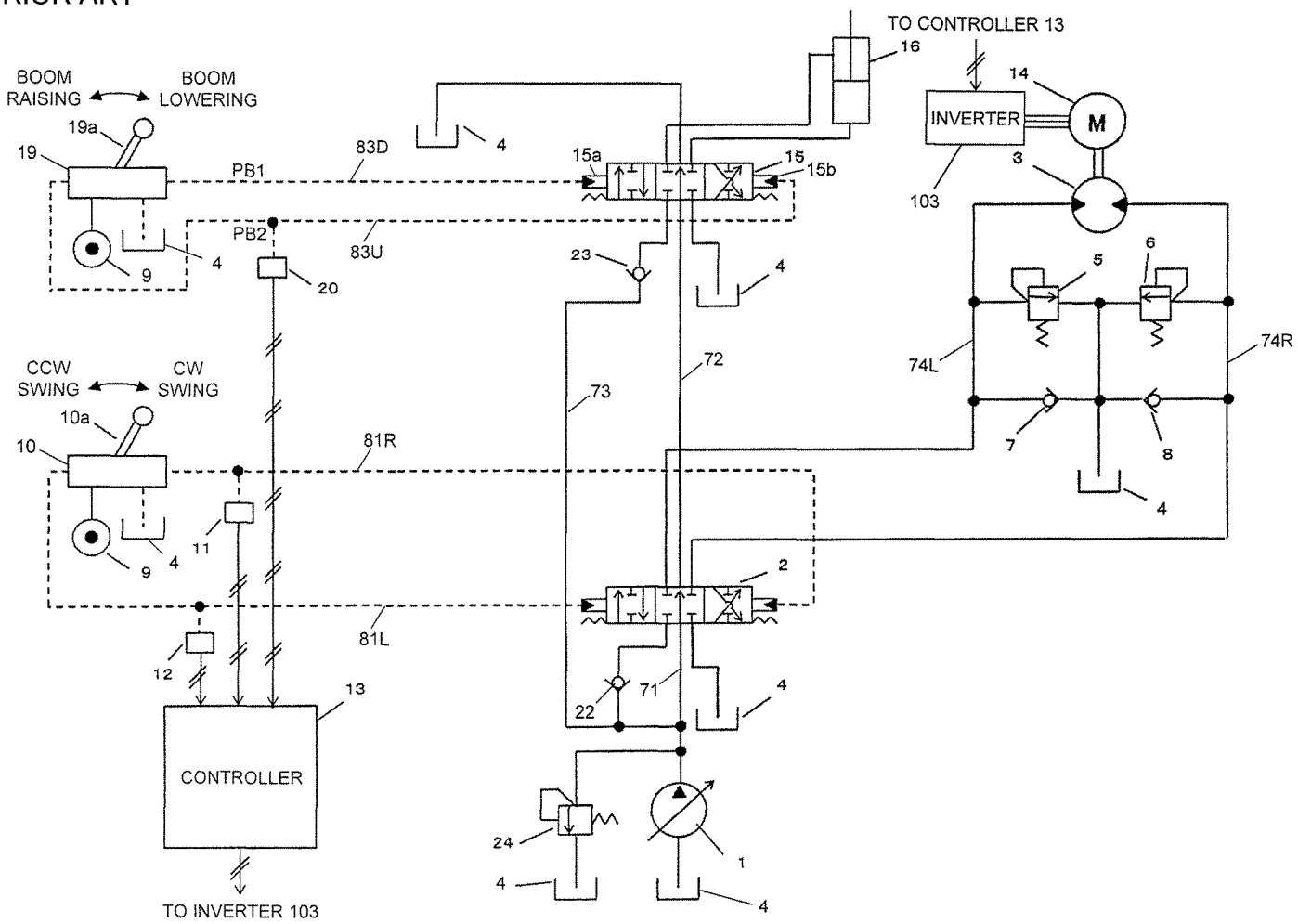
Fig. 6 PRIOR ART
FIG. 6 is a schematic block diagram of an conventional hydraulic system.

FIG. 6 is a schematic block diagram of a hydraulic system mounted on a conventional hydraulic excavator. In this open center hydraulic system, a directional control valve 2 for swing and the directional control valve 15 for the boom each include a center bypass opening that communicates with the tank 4, a meter-in opening through which the hydraulic fluid supplied to the hydraulic actuators 3 and 16 flows, and a meter-out opening through which the hydraulic fluid returning from the hydraulic actuators 3 and 16 flows.

When the control lever 10*a* or 19*a* of each operating device 10 or 19 is operated to switch the directional control valve 2 or 15 (positioned in neutral in the drawing) in either the rightward or the leftward direction, the meter-in opening is opened to let the hydraulic fluid flow into the hydraulic actuator 3 or 16, and the meter-out opening is also opened to let the hydraulic fluid returning from the hydraulic actuator 3 or 16 flow into the tank 4.

When the directional control valve 2 or 15 positioned in neutral in the drawing is shifted in either the rightward or the leftward direction, the center bypass opening is throttled. This raises the differential pressure of the hydraulic fluid between before and after the center bypass opening to boost the discharge pressure (pump pressure) of the hydraulic pump 1. When the pump pressure becomes higher than a pressure (actuator load pressure) needed to drive a hydraulic actuator, the hydraulic fluid from the hydraulic pump 1 flows into the hydraulic actuator to drive it. Moreover, when the hydraulic fluid from the hydraulic pump 1 flows into the hydraulic actuator 3 or 16, the area of the center bypass opening determines the ratio of the hydraulic fluid branching into the hydraulic actuator 3 or 16 to the hydraulic fluid branching into the center bypass hydraulic line 72, whereby the operating speed of the hydraulic actuator 3 or 16 is controlled.

As described above, the center bypass opening of the directional control valve 2 or 15 is optimally set in accordance with the amount of the load exerted on the hydraulic actuator 3 or 16 as the drive target and in keeping with the operation amount of the control lever 10*a* or 19*a* of each operating device 10 or 19 (pilot pressure).

For example, the center bypass opening of the directional control valve 2 for swing is set as follows: When the operator operates the control lever 10*a* of the swing operating device 10 slightly in a desired direction, the operator is demanding a low-speed swing. When the upper swing structure of the hydraulic excavator is swung at low speed, the load involved is low so that there is no need to boost the pump pressure significantly. For this reason, the center bypass opening of the directional control valve 2 for swing is set to be relatively wide (throttle amount is relatively small).

For example, the center bypass opening of the directional control valve 15 for the boom is set as follows: When the operator operates the control lever 19*a* of the boom operating device 19 slightly in the boom raising direction, the operator is demanding a low-speed boom raising operation. However, at the time of cargo lifting work, the bucket is loaded and the boom load is high so that the pump pressure needs to be boosted significantly to drive the boom. For this reason, the center bypass opening of the directional control valve 15 for the boom in the boom raising direction (right position in the drawing) is set to be relatively small (throttle amount is relatively large) in order to supply the hydraulic fluid to the bottom-side hydraulic chamber of the boom cylinder 16.

As described above, even when the operation amount of the lever is the same, the optimal setting of the center bypass opening that ensures both operability and efficiency is different depending on the load and speed of the hydraulic actuator as the drive target. Furthermore, the hydraulic system mounted on the hydraulic excavator or the like is generally configured in such a manner that the hydraulic fluid delivered from one hydraulic pump is suitably branched by multiple directional control valves to drive multiple hydraulic actuators. In the above open center type, the directional control valves 2 and 15 are serially connected via the center bypass hydraulic line 72. The center bypass openings of the directional control valves 2 and 15 combine to determine the pump pressure and the flow rate of the hydraulic fluid flowing into the hydraulic actuators 3 and 16.

The conventional hydraulic system shown in FIG. 6 corresponds to the hydraulic system according to this embodiment in FIG. 2 minus the solenoid pressure reducing valves 30 and 31, with the single directional control valve 2 replacing the first and the second directional control valves 28 and 29. In the hydraulic system according to this embodiment, the upper swing structure 50 is driven by the output torque of the electric swing motor 14 alone at the time of combined swing operation. In the conventional hydraulic system, by contrast, the upper swing structure 50 is driven by the total output torque of the hydraulic swing motor 3 and electric swing motor 14 at the time of the combined swing operation.

In the open center hydraulic system shown in FIG. 6, the directional control valve 2 for swing and the directional control valve 15 for the boom are disposed on the same center bypass hydraulic line 72. This disposition causes the following phenomenon during cargo lifting work, for example.

Suppose that the operator is lifting a cargo at low speed in solo boom raising operation. The center bypass opening of the directional control valve 15 for the boom is throttled large so as to supply the hydraulic fluid to the boom cylinder 16 even under heavy load. Therefore, when the control lever 19*a* of the boom operating device 19 is operated even slightly in the boom raising direction, the pump pressure is increased to exceed the boom load pressure and thereby extend the boom cylinder 16 lifting the cargo. When the cargo is lifted to the intended height, the operator returns the control lever 19*a* to neutral to stop the boom raising operation.

Suppose now that the operator is moving the cargo horizontally at low speed in solo swing operation. Although the center bypass opening of the directional control valve 2 for swing is set to be wider than the center bypass opening of the directional control valve 15 for the boom, operating the control lever 10*a* of the swing operating device 10 even slightly causes the upper swing structure 50 to start swinging since the swing load is not increased with the cargo being lifted. Accordingly, even during cargo lifting work, the pump pressure and the flow rate of the hydraulic fluid flowing into the hydraulic actuator 3 or 16 are controlled as intended so long as swing operation and boom raising operation are performed independently since the center bypass throttle of the directional control valve 2 for swing and that of the directional control valve 15 for the boom are each set appropriately.

By contrast, suppose that the operator performs combined swing operation (swing boom raising operation) in which the boom is raised during solo swing operation in order to move the cargo obliquely upward. Since the directional control valve 2 for swing and the directional control valve 15 for the boom are disposed on the same center bypass hydraulic line 72, the center bypass opening of the directional control valve 15 for the boom also functions as the center bypass opening of the directional control valve 2 for swing. That is, the boom raising operation throttling the center bypass of the directional control valve 15 for the boom technically equals that the center bypass of the directional control valve 2 for swing is throttled. This changes the balance between the center bypass flow rate and the meter-in flow rate of the directional control valve 2 for swing. Furthermore, since the boom raising load is higher than the swing load, more hydraulic fluid tends to flow into the hydraulic swing motor 3. Accordingly, the swing can be accelerated by the hydraulic fluid flowing into the hydraulic swing motor 3 unintentionally. Unintended acceleration of the swing during cargo lifting work is not desirable because it will cause the lifted cargo to sway.

Effects

In the face of such problems, the hydraulic system according to the embodiment configured as above prevents the operation of the first directional control valve 28 for meter-in control during swing boom raising operation. This prevents the hydraulic fluid from flowing into the hydraulic swing motor 3 even when the pump pressure is raised during swing boom raising operation so that unintended acceleration of the upper swing structure 50 can be avoided. Moreover, when the operator starts swing operation during boom raising operation, the hydraulic fluid is prevented from flowing into the hydraulic swing motor 3 so that unintended deceleration of boom raising operation can be avoided. Boom raising operation and swing operation being performed independently as above, the operator is provided with high manipulability during combined swing operation. In particular, the independent operation makes it easier to perform cargo lifting work in which the bucket 65 is moved to and stopped at the target position by swing boom raising operation.

Furthermore, while the operation of the first directional control valve 28 for meter-in control is prevented at the time of combined swing operation, the second directional control valve 29 for meter-out control is switched to let the braking torque of the hydraulic swing motor 3 work on the upper swing structure 50. This makes it possible to bring the manipulability during swing in the combined swing operation in which the hydraulic swing motor 3 is not driven, close to the manipulability in the solo swing operation in which the hydraulic swing motor 3 is driven.

Second Embodiment

Figure 7:
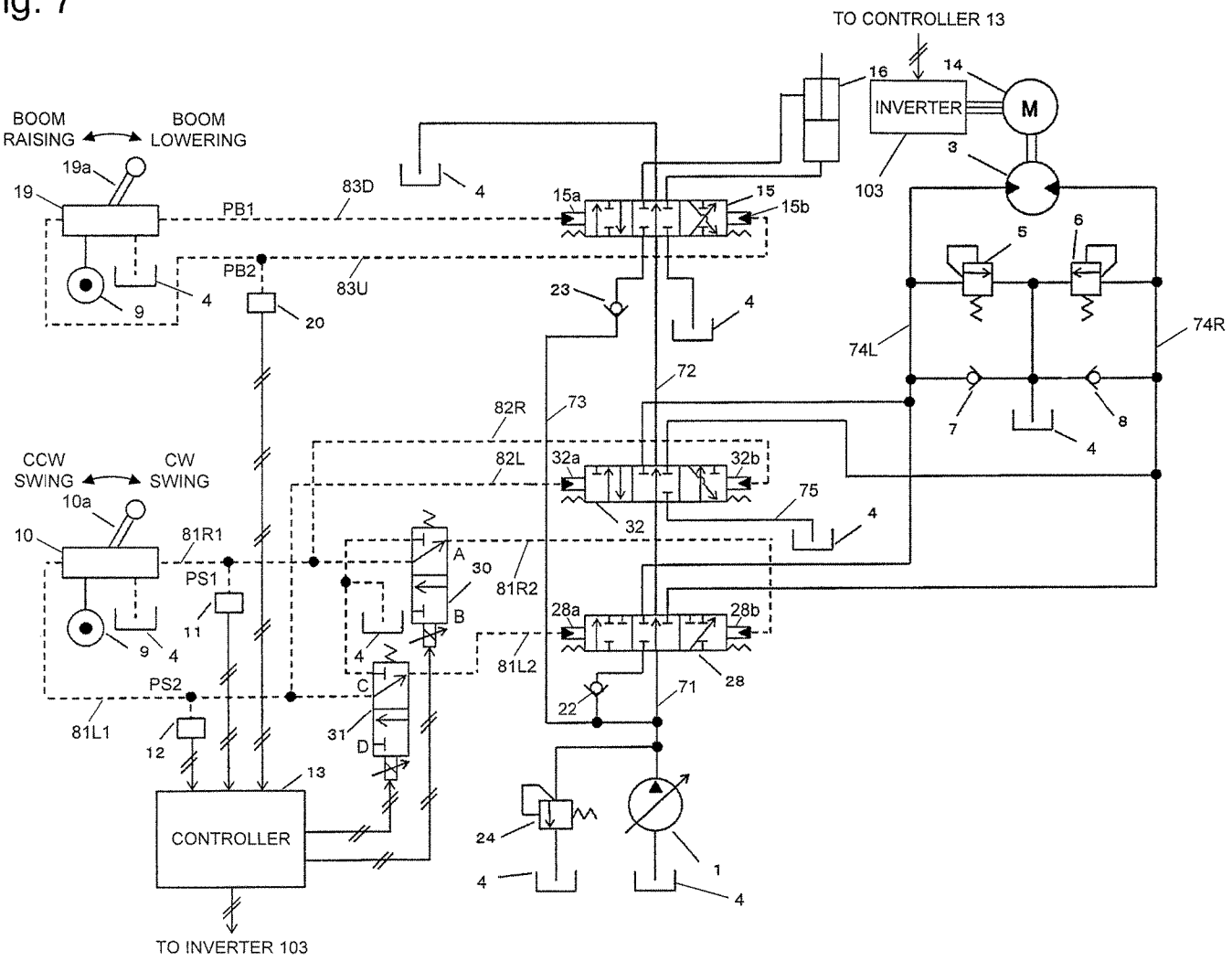
FIG. 7 is a schematic block diagram of a hydraulic system according to a second embodiment of the present invention.

FIG. 7 is a schematic block diagram of a hydraulic system according to a second embodiment of the present invention. The difference between the hydraulic system according to the first embodiment (in FIG. 2) and the hydraulic system according to the second embodiment is that the second directional control valve 29 (in FIG. 2) is replaced with a second directional control valve 32 having a center bypass opening and disposed on the center bypass hydraulic line 72.

The center bypass opening of the second directional control valve 32 is set to not throttle the center bypass hydraulic line when the second directional control valve 32 is switched in any of the rightward and leftward directions. That is, the second directional control valve 32 for meter-out control does not have the function of controlling the flow rate of the hydraulic fluid returning from the hydraulic pump 1 to the tank 4 through the center bypass hydraulic line 72. Accordingly, as with the first embodiment, the switching of the second directional control valve 32 does not change the flow rates of the hydraulic fluid distributed to the boom cylinder 16 and to the tank 4, the fluid being distributed through switching of the directional control valve 15 for the boom. This characteristic that the flow rates do not change makes it possible to keep swing operation and boom raising operation independent of each other during swing boom raising operation.

The control of the solenoid pressure reducing valves 30 and 31 and of the inverter device 103 performed by the controller 13 in the second embodiment is the same as in the first embodiment.

The second embodiment configured as described above thus offers the same effects as the first embodiment.

Moreover, the center bypass opening formed in the second directional control valve 32 allows the second directional control valve 32 to be arranged in a single valve block that includes the other second directional control valves 28 and 15. This arrangement makes it easier to manufacture the second directional control valve 32 and its peripheral hydraulic circuits.

Third Embodiment

Figure 8:
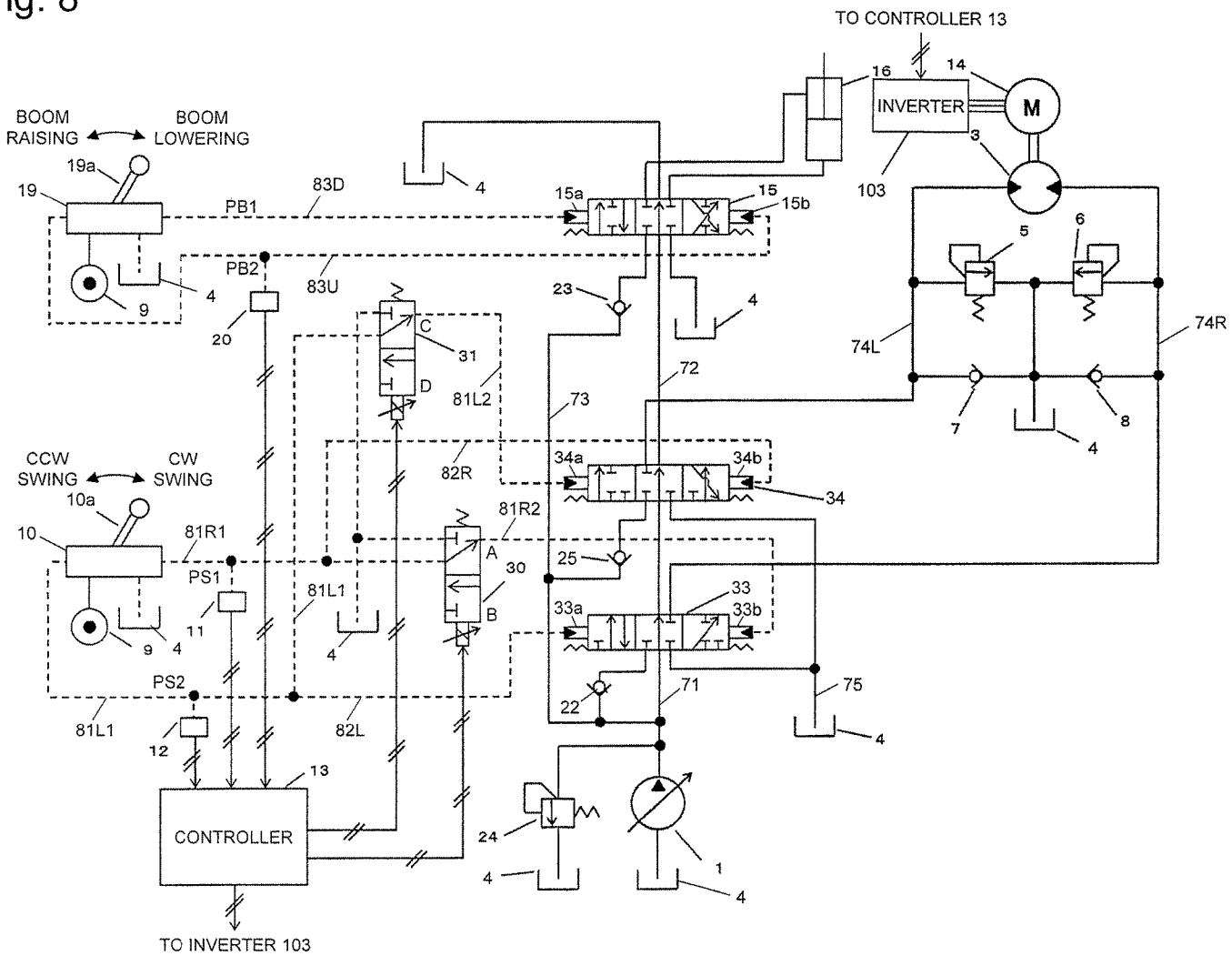
FIG. 8 is a schematic block diagram of a hydraulic system according to a third embodiment of the present invention.

FIG. 8 is a schematic block diagram of a hydraulic system according to a third embodiment of the present invention. The difference between the hydraulic system according to the second embodiment (in FIG. 7) and the hydraulic system according to the third embodiment is that the first directional control valve 28 (in FIG. 7) is replaced with a first directional control valve 33 and the second directional control valve 32 (in FIG. 7) with a second directional control valve 34.

The first and the second directional control valves 33 and 34 are each provided with a meter-in opening, a center bypass opening, and a meter-out opening. The first and the second directional control valves 33 and 34 are connected to the meter-in hydraulic line 73 via check valves 22 and 25, respectively, so as to supply the hydraulic swing motor 3 with the hydraulic fluid delivered from the hydraulic pump 1 via the actuator hydraulic lines 74R and 74L, respectively. The first and the second directional control valves 33 and 34 are also connected to the hydraulic fluid drain line 75 to cause the hydraulic fluid discharged from the hydraulic swing motor 3 into the actuator hydraulic lines 74R and 74L to return to the tank 4.

The first directional control valve 33, when switched to the right position (in the leftward direction), widens the meter-in opening connecting the meter-in hydraulic line 73 to the actuator hydraulic line 74R and does not open the meter-out opening connecting the actuator hydraulic line 74R to the hydraulic fluid drain line 75. By contrast, when switched to the left position (in the rightward direction), the first directional control valve 33 does not throttle the center-bypass opening, does not open the meter-in opening, and widens the meter-out opening connecting the actuator hydraulic line 74R to the hydraulic fluid drain line 75.

The second directional control valve 34, when switched to the left position (in the rightward direction), throttles the center bypass opening, widens the meter-in opening connecting the meter-in hydraulic line 73 to the actuator hydraulic line 74L, and does not open the meter-out opening connecting the actuator hydraulic line 74R to the hydraulic fluid drain line 75. On the other hand, when switched to the right position (in the leftward direction), the second directional control valve 34 does not throttle the center bypass opening, does not open the meter-in opening, and widens the meter-out opening connecting the actuator hydraulic line 74L to the hydraulic fluid drain line 75.

The pilot pressure PS1 or PS2 generated by the swing operating device 10 is led to a pressure receiving part 33*b* of the first directional control valve 33 for swing or to a pressure receiving part 34*a* of the second directional control valve 34 via pilot hydraulic lines 81R1, 81R2 or 81L1, 81L2. The pilot pressure PS1 or PS2 is also led to a pressure receiving part 34*b* of the second directional control valve 34 or to a pressure receiving part 33*a* of the first directional control valve 33 via the pilot hydraulic line 82R or 82L branched from the pilot hydraulic line 81R1 or 81L1, respectively.

When the control lever 10*a* of the swing operating device 10 is operated in the clockwise swing direction and the pilot pressure PS1 is thereby generated in the pilot hydraulic line 81R1, the pilot pressure PS1 led via the pilot hydraulic line 82R branched from pilot hydraulic line 81R1 switches the second directional control valve 34 to the right position (in the leftward direction) to control the flow of the hydraulic fluid returning from the hydraulic swing motor 3 (meter-out control). Further, when the solenoid pressure reducing valve 30 is at the position A, the pilot pressure PS1 switches the first directional control valve 33 to the right position (in the leftward direction) to control the flow of the hydraulic fluid supplied to the hydraulic swing motor 3 (meter-in control). This causes the upper swing structure 50 to be driven to swing clockwise by the output torque of the hydraulic swing motor 3.

By contrast, when the control lever 10*a* of the swing operating device 10 is operated in the counterclockwise swing direction and the pilot pressure PS2 is thereby generated in the pilot hydraulic line 81L1, the pilot pressure PS2 led via the pilot hydraulic line 82L branched from pilot hydraulic line 81L1 switches the first directional control valve 33 to the left position (in the rightward direction) to control the flow of the hydraulic fluid returning from the hydraulic swing motor 3 (meter-out control). Further, when the solenoid pressure reducing valve 31 is at the position C, the pilot pressure PS2 switches the second directional control valve 34 to the left position (in the rightward direction) to control the flow of the hydraulic fluid supplied to the hydraulic swing motor 3 (meter-in control). This causes the upper swing structure 50 to be driven to swing counterclockwise by the output torque of the hydraulic swing motor 3.

As described above, when the upper swing structure 50 is driven to swing clockwise by the hydraulic swing motor 3, the first directional control valve 33 serves as the directional control valve for meter-in control and the second directional control valve 34 serves as the directional control valve for meter-out control. By contrast, when the upper swing structure 50 is driven to swing counterclockwise by the hydraulic swing motor 3, the second directional control valve 34 serves as the directional control valve for meter-in control and the first directional control valve 33 serves as the directional control valve for meter-out control. That is, in the third embodiment as well, the two directional control valves 33 and 34 also perform meter-in control and meter-out control separately, the meter-in control controlling the flow of the hydraulic fluid flowing to the hydraulic swing motor 3, the meter-out control controlling the flow of the hydraulic fluid returning from the hydraulic swing motor 3.

The flow rates of the hydraulic fluid distributed to the boom cylinder 16 and to the tank 4 by switching of the directional control valve 15 for the boom remain unchanged regardless of the first directional control valve 33 being switched to the left position or the second directional control valve 34 being switched to the right position. That is, the directional control valve 33 or 34 for meter-out control does not have the function of controlling the flow rate of the hydraulic fluid returning from the hydraulic pump 1 to the tank 4 through the center bypass hydraulic line 72. This makes it possible to keep swing operation and boom raising operation independent of each other in swing boom raising operation, as in the case of the first and the second embodiments.

The control of the solenoid pressure reducing valves 30 and 31 and of the inverter device 103 performed by the controller 13 in the third embodiment is the same as in the first and the second embodiments.

The third embodiment configured as described above thus offers the same effects as the first and the second embodiments.

Variations

While the combined operation of swing and boom raising has been described above in each of the above embodiments, the present invention is effective not only in the combined operation involving the boom 61 but also in combined operation involving another hydraulic actuator. That is because the major problem addressed by this invention is that the swing during combined swing operation is accelerated (subject to speed change) by the delivery pressure of the hydraulic pump (pump pressure) being raised by operation of a hydraulic actuator other than the hydraulic swing motor.

While each of the above embodiments has explained, as an example, the hydraulic system configured by parallel circuits in which all directional control valves are connected to the hydraulic pump, the present invention may also be applied to any hydraulic system in which more hydraulic fluid flows to the hydraulic swing motor that is less loaded than another hydraulic actuator when the operator simultaneously operates the hydraulic swing motor and the another hydraulic actuator. That is, the invention can be applied to the hydraulic system configured by a tandem circuit in which the hydraulic fluid is supplied preferentially to the hydraulic swing motor rather than to other hydraulic actuators including the boom cylinder. Furthermore, the invention can be applied not only to open center hydraulic systems but also to closed center hydraulic systems.

Each of the above embodiments has a configuration in which the pilot pressures PS1 and PS2 outputted from the swing operating device 10 are detected by the pressure sensors 11 and 12 to be converted to electrical signals that are thereafter outputted to the controller 13. Alternatively, it may have a configuration in which an electrical operation signal based on the operation amount of the control lever 10*a* of the swing operating device 10 is outputted to the controller 13. In this case, a position sensor (e.g., rotary encoder) may be used to detect the rotational displacement of the control lever 10*a* of the swing operating device 10.

While each of the above embodiments uses, as the directional control valves, pilot valves whose positions are controlled by pilot pressures, it may also use solenoid valves whose positions are controlled by electrical signals. The solenoid pressure reducing valves 30 and 31 in each of the above embodiments may be an on-off valve that disconnects the pilot hydraulic lines 81R1 and 81R2 from each other and an on-off valve that disconnects the pilot hydraulic lines 81L1 and 81L2 from each other.

Furthermore, while the above embodiments use only the pressure sensors 11 and 22 to detect the operation amount of the control lever 10*a* of the swing operating device 10, it may use a combination of sensors of different detection methods, such as the pressure sensors 11 and 12 in combination with the above-mentioned position sensors. In this case, if one type of sensor is defective, the other type of sensor can detect the operation amount so that the reliability of the system is improved.

The present invention is not limited to the above embodiments and may include varieties of modifications without departing from the spirit of the invention. For example, the present invention is not limited to the configurations containing all constituent elements described in the above embodiments and may include a configuration, part of which is removed. In addition, a part of the configuration of a certain embodiment may be replaced by a part of the configuration of another embodiment or may be added to the configuration of another embodiment.

What is claimed is:

1. A hybrid construction machine comprising:

a swing structure;

a hydraulic pump;

a hydraulic swing motor driving the swing structure using hydraulic fluid from the hydraulic pump;

an electric swing motor driving the swing structure in conjunction with the hydraulic swing motor;

a boom cylinder operated simultaneously with the swing structure at times and driven by the hydraulic fluid from the hydraulic pump;

first sensors to detect a presence or absence of a boom raising operation by the boom cylinder;

second sensors to detect a presence or absence of a swing operation of the swing structure;

a first directional control valve for meter-in control controlling flow of the hydraulic fluid supplied from the hydraulic pump to the hydraulic swing motor;

a second directional control valve for meter-out control controlling the flow of the hydraulic fluid returning from the hydraulic swing motor;

at least one pressure reducing valve regulating operation of the first directional control valve for meter-in control; and a controller for controlling the at least one pressure reducing valve;

wherein, the controller, upon judging that a combined swing operation is performed in which the boom cylinder is operated simultaneously with the swing structure based on a detection result by the first and the second detectors, prevents the operation of the first directional control valve for meter-in control with the at least one pressure reducing valve, thereby causing the swing structure to be driven by the electric swing motor alone, and the flow of the hydraulic fluid returning from the hydraulic swing motor is controlled by a switching operation of the second directional control valve for meter-out control.

2. The hybrid construction machine according to claim 1, wherein the first directional control valve for meter-in control is disposed on a center bypass hydraulic line constituting part of the hydraulic line for connecting the hydraulic pump to a tank, and has a function of controlling the flow rate of the hydraulic fluid flowing from the hydraulic pump to the tank; and wherein the second directional control valve for meter-out control is disposed on a hydraulic line other than the center bypass hydraulic line.

3. The hybrid construction machine according to claim 1, wherein the first directional control valve for meter-in control is disposed on a center bypass hydraulic line constituting part of the hydraulic line for connecting the hydraulic pump to a tank, and has a function of controlling the flow rate of the hydraulic fluid flowing from the hydraulic pump to the tank; and wherein the second directional control valve for meter-out control is disposed on the center bypass hydraulic line, and does not have the function of controlling the flow rate of the hydraulic fluid flowing from the hydraulic pump to the tank.

4. The hybrid construction machine according to claim 1, wherein the first directional control valve for meter-in control and the second directional control valve for meter-out control are switched by the same operating pilot pressure; and wherein the at least one pressure reducing valve has a valve mechanism for blocking the operating pilot pressure led to the first directional control valve for meter-in control when the boom cylinder is operated simultaneously with the swing structure.

* * * * *